US006992243B2

(12) United States Patent
Small

(10) Patent No.: US 6,992,243 B2
(45) Date of Patent: Jan. 31, 2006

(54) STRINGED INSTRUMENT WITH TONAL CONTROL

(75) Inventor: Craig A. Small, Hopkinton, MA (US)

(73) Assignee: First Act Inc., Boston, MA (US)

( * ) Notice: Subject to any disclaimer, the term of this patent is extended or adjusted under 35 U.S.C. 154(b) by 48 days.

(21) Appl. No.: 10/681,291

(22) Filed: Oct. 9, 2003

(65) Prior Publication Data

US 2005/0076775 A1 Apr. 14, 2005

(51) Int. Cl.
*G10D 1/08* (2006.01)

(52) U.S. Cl. ..... 84/267; 84/723

(58) Field of Classification Search ..... 84/267, 84/723, 725, 730, 731, 726, 290, 281, 293, 84/743

See application file for complete search history.

(56) References Cited

U.S. PATENT DOCUMENTS 3,780,202 A * 12/1973 Law ..... 84/726
4,616,548 A * 10/1986 Anderson ..... 84/743
5,072,646 A * 12/1991 Valkama ..... 84/726

* cited by examiner

*Primary Examiner*—Kimberly Lockett
(74) *Attorney, Agent, or Firm*—John E. Toupal; Harold G. Jarcho

(57) ABSTRACT

A stringed instrument including a body having a top surface defining a picking area; a bridge supported by the top surface at one end of the picking area; a neck extending from the body at an opposite end of the picking area; and a plurality of strings extending in substantially parallel paths over the picking area. Each pickup is disposed under a different associated one of the strings and a support mechanism mounted on the top surface and adapted to accommodate movement of each pickup in a path within the picking area and parallel to its associated string.

15 Claims, 3 Drawing Sheets

STRINGED INSTRUMENT WITH TONAL CONTROL

BACKGROUND OF THE INVENTION

The invention relates generally to stringed instruments and, more particularly, to stringed instruments providing variable tone adjustments.

Traditional stringed instruments such as guitars employ pickup devices to generate signals having frequencies dependent on tones produced by picking action of strings in a picking area. Those signals then are fed to amplifiers and speakers to provide audio outputs replicating the picked sound. Typically, a desired tonal output is provided by positioning of the pickup device under the strings of the guitar. However, selective variation of tonal output in prior string instruments is quite limited.

The object of this invention, therefor, is to provide a stringed instrument which allows extensive selective variations in tonal audio output.

SUMMARY OF THE INVENTION

The invention is a stringed instrument including a body having a top surface defining a picking area; a bridge supported by the top surface at one end of the picking area; a neck extending from the body at an opposite end of the picking area; and a plurality of strings extending in substantially parallel paths over the picking area. Also included are a plurality of pickups each disposed under a different associated one of the strings and a support mechanism mounted on the top surface and adapted to accommodate movement of each pickup in a path within the picking area and parallel to its associated string. Selective movement of the pickups under the associated strings provides desired tonal output variation.

According to one feature of the invention, each path of movement extends over a substantial portion of the picking area and, preferably, between positions directly adjacent opposite ends of the picking area. This feature maximizes achievable tonal output variation.

According to another feature of the invention, the support means includes rails supporting the pickups and shaped and arranged to guide movement of the pickups along the parallel paths. The rails facilitate desired movement of the pickups.

According to yet another feature of the invention, the mechanism further includes carriages retaining the pickups and adapted for movement on the rails. The carriages simplify mounting of the pickups for movement on the rails.

According to still another feature of the invention, the carriages retain first contacts connected to the pickups and the mechanism includes second elongated contacts shaped and arranged for sliding engagement with the first contacts during movement of the carriages. The first and second slidably engaged contacts maintain electrical contact with the pickups in any position.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENTS

Figure 1:
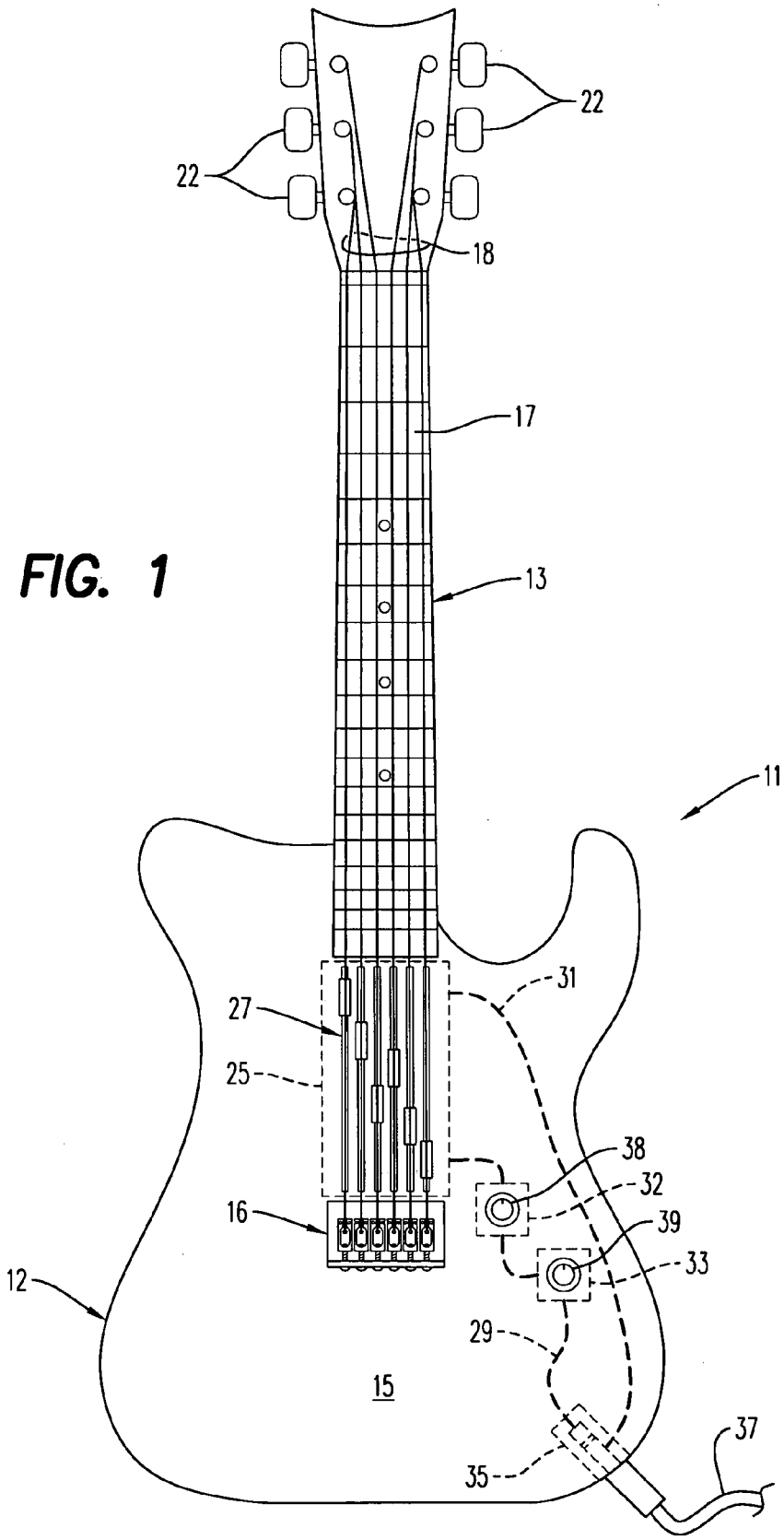
FIG. 1 is a top view of a guitar according to the invention.

A stringed instrument 11 includes a body 12 and a neck 13 extending from an edge of the body. Mounted on a top surface 15 of the body is a bridge 16 while the neck retains a fret board 17. A plurality of strings 18 extend in substantially parallel paths over the fret board 17 and a portion of the top surface 15. The strings 18 extend between the bridge 16 mounted on the top surface 15 and tuning screws 22 located at an outer end of the neck 13. Located between the bridge 16 and the fret board 17 is the picking area 25 of the top surface 15 above which the strings 18 can be picked to produce sound. The picking area is identified by dashed lines in FIG. 1.

Mounted on the top surface 15 within the picking area 25 is a support assembly 27 which supports a plurality of pickups 28 each disposed below an associated different one of the strings 18. The pickups 28 are connected by cables 29 and 31 to volume and tone control circuits 32, 33 and an output jack 35 all mounted within the body 12 and shown by dashed lines in FIG. 1. A cable 37 feeds signals from the output jack 35 to an amplifier (not shown). Controlling the volume and tone circuits 32, 33 are knobs 38, 39 located on the top surface 15 of the body 12.

Figure 2:
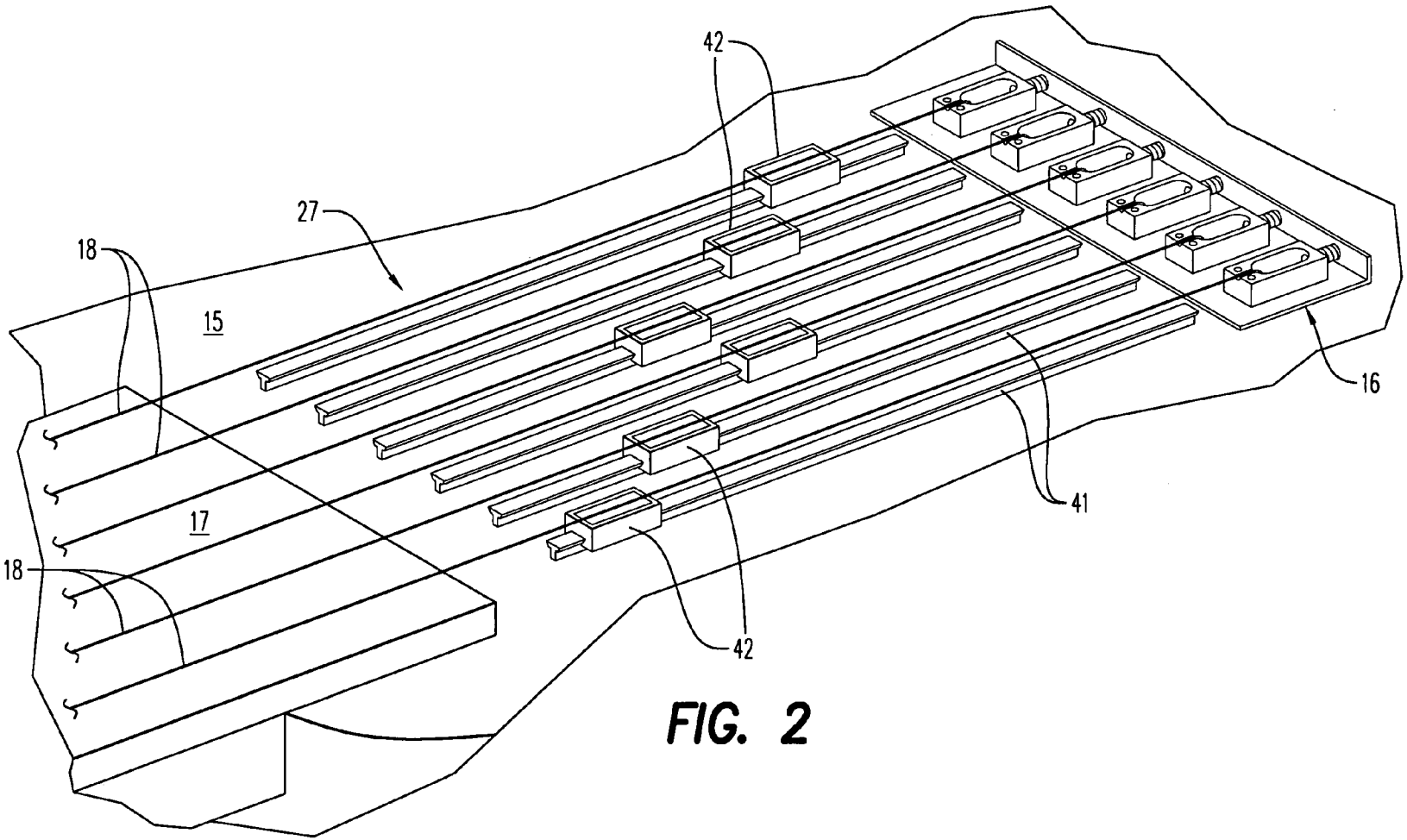
FIG. 2 is a detailed perspective view of a tonal output control in a picking area section on the top surface of the guitar.
Figure 3:
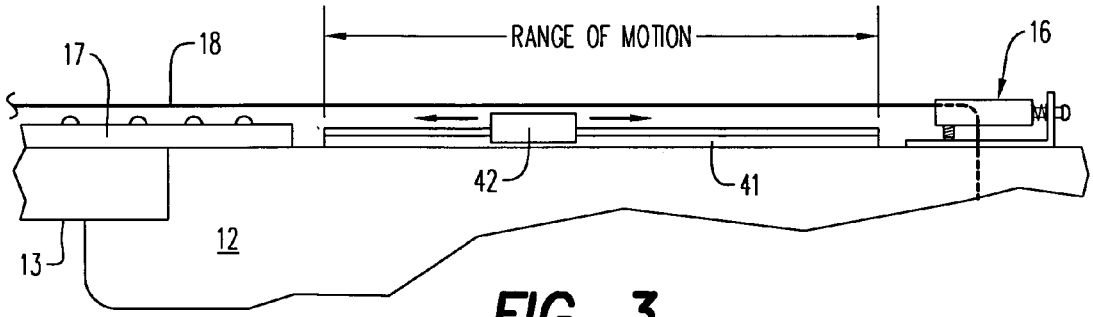
FIG. 3 is a side view of the control shown in FIG. 2.

As illustrated in FIG. 2, the support assembly 27 includes a plurality of rails 41 each mounted on the top surface 15 under a different one of the strings 18 and extending parallel thereto. A carriage 42 retaining one of the pickups 28 is mounted for movement along each of the rails 41. As depicted in FIG. 3, the rails provide for the pickups 28 linear motion over a substantial portion of the picking area 25 extending between positions directly adjacent opposite ends thereof. Although the embodiment of FIGS. 1–3 shows six strings and pickups, it will be understood that more or less of each could be used if desired.

Figure 4:
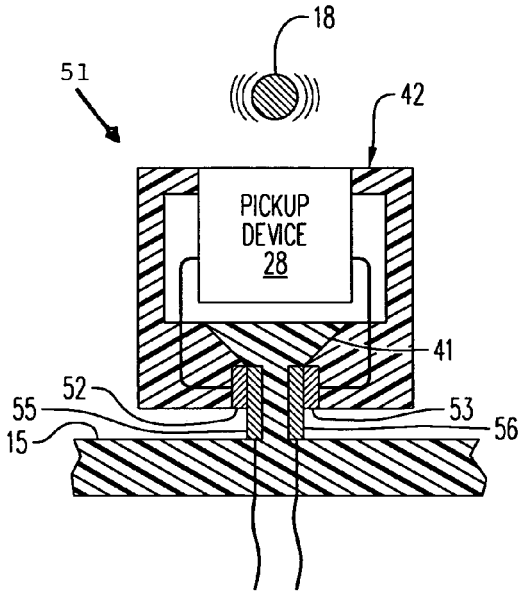
FIG. 4 is a sectional view of one carriage and pickup embodiment of the control shown in FIGS. 1–3.

One moveable pickup embodiment 51 is shown in FIG. 4. The carriage 42 is mounted for linear movement along the rail 41 and retains a pickup 28. Signal outputs of the pickup 28 are connected to first electrical contacts 52, 53 mounted on the carriage 42. During movement of the carriage 42, the first contacts 52, 53 are in sliding engagement with elongated second contacts 55, 56 on the rail 41.

Figure 5:
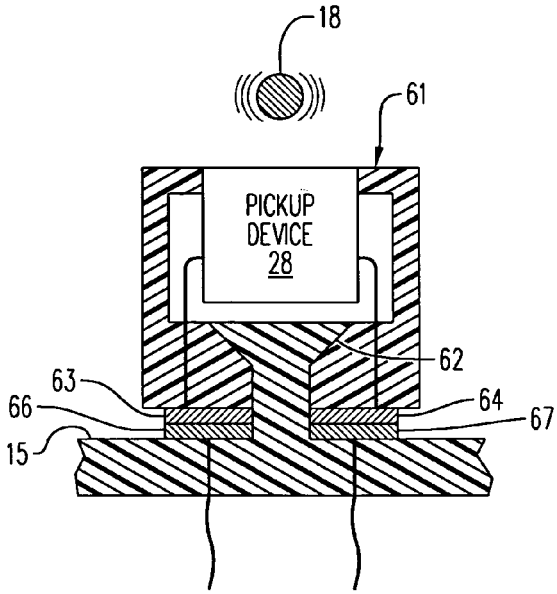
FIG. 5 is a sectional view of another carriage and pickup embodiment of the control shown in FIGS. 1–3.

Another carriage embodiment 61 is depicted in FIG. 5. The carriage 61 again is mounted for linear movement on a rail 62 and retains a pickup 28 which feeds output signals to contacts 63, 64. However, the contacts 63, 64 in embodiment 61 slidably engage second elongated contacts 66, 67 mounted on the top surface 15 rather than the rail 62

During use of the instrument 11. each pickup 28 can be independently and selectively moved on its supporting rail 41, 62 along a path parallel to the associated string 18 located directly above in the picking area 25. The tonal sound output provided by the pickups 28 is varied by their selective positioning beneath the strings 18. Pickups 28 located close to the bridge 16 produce a treble-rich sound with slight midrange frequencies while pickups located in mid-positions produce less treble, more midrange frequencies and slightly more bass and pickups located near the neck 13 produce even less treble, and more midrange and bass frequencies. Thus, a wide range of selective tonal variation outputs are provided.

Obviously, many modifications and variations of the present invention are possible in light of the above teaching. It is to be understood, therefore, that the invention can be practiced otherwise than as specifically described.

What is claimed is:

1. A stringed instrument comprising:

a body having a top surface defining a picking area:

a bridge supported by said top surface at one end of said picking area;

a neck extending from said body at an opposite end of said picking area;

a plurality of strings extending in substantially parallel paths over said picking area;

a plurality of pickups each disposed under a different associated one of said strings;

rail means supporting said pickups and shaped and arranged to guide movement of said pickups along said paths;

carriage means retaining said pickups and adapted for movement on said rail means;

first contacts retained by said carriage means and connected to said pickups; and second elongated contacts shaped and arranged for sliding engagement with said first contacts during movement of said carriage means.

2. A stringed instrument according to claim 1 wherein each said path extends over a substantial portion of said picking area.

3. A stringed instrument according to claim 2 wherein said paths extend between positions directly adjacent, respectively, said one end and said opposite end of said picking area.

4. A stringed instrument according to claim 1 wherein said support means is adapted to accommodate selective independent movement of each of said pickups.

5. A stringed instrument according to claim 4 wherein each said path extends over a substantial portion of said picking area.

6. A stringed instrument according to claim 5 wherein said paths extend between positions directly adjacent, respectively, said one end and said opposite end of said picking area.

7. A stringed instrument comprising:

a body having a top surface defining a picking area;

a bridge supported by said top surface at one end of said picking area;

a neck extending from said body at an opposite end of said picking area;

a plurality of strings extending in substantially parallel paths over said picking area;

a plurality of pickups each disposed under a different associated one of said strings; and support means mounted on said top surface and adapted to accommodate selective independent movement of each said pickup in a path within said picking area and parallel to its associated string.

8. A stringed instrument according to claim 7 wherein each said path extends over a substantial portion of said picking area.

9. A stringed instrument according to claim 8 wherein said paths extend between positions directly adjacent, respectively, said one end and said opposite end of said picking area.

10. A stringed instrument according to claim 7 wherein said support means comprises rail means supporting said pickups and shaped and arranged to guide movement of said pickups along said paths.

11. A stringed instrument according to claim 10 wherein each said path extends over a substantial portion of said picking area.

12. A stringed instrument according to claim 11 wherein said paths extend between positions directly adjacent, respectively, said one end and said opposite end of said picking area.

13. A stringed instrument according to claim 10 wherein said support means further comprises carriage means retaining said pickups and adapted for movement on said rail means.

14. A stringed instrument according to claim 13 wherein each said path extends over a substantial portion of said picking area.

15. A stringed instrument according to claim 14 wherein said paths extend between positions directly adjacent, respectively, said one end and said opposite end of said picking area.

* * * * *